US006719472B2

(12) United States Patent
Windorski et al.

(10) Patent No.: US 6,719,472 B2
(45) Date of Patent: Apr. 13, 2004

(54) WRITING INSTRUMENT WITH SHEET DISPENSER

(75) Inventors: David C. Windorski, Woodbury, MN (US); Jonathan P. Van Dore, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 13 days.

(21) Appl. No.: 10/185,331

(22) Filed: Jun. 27, 2002

(65) Prior Publication Data

US 2003/0000958 A1 Jan. 2, 2003

Related U.S. Application Data

(60) Provisional application No. 60/301,641, filed on Jun. 28, 2001.

(51) Int. Cl.[7] ..... B43K 29/00
(52) U.S. Cl. ..... 401/195
(58) Field of Search ..... 401/52, 195

(56) References Cited

U.S. PATENT DOCUMENTS

| | | | | | |
|---|---|---|---|---|---|
| 2,073,719 | A | * | 3/1937 | Ross | 242/588.1 |
| 3,963,358 | A | * | 6/1976 | Houser | 401/195 |
| 4,416,392 | A | | 11/1983 | Smith | |
| 4,770,320 | A | | 9/1988 | Miles et al. | |
| 4,781,306 | A | | 11/1988 | Smith | |
| 4,907,825 | A | | 3/1990 | Miles et al. | |
| 4,963,048 | A | * | 10/1990 | Thomas et al. | 401/195 |
| 4,978,006 | A | | 12/1990 | Juteau | |
| 4,989,801 | A | * | 2/1991 | Thomas et al. | 242/588 |
| 5,417,345 | A | | 5/1995 | Smith | |
| 6,247,864 | B1 | * | 6/2001 | Walsh | 401/195 |
| 6,354,754 | B1 | | 3/2002 | Pan | |

FOREIGN PATENT DOCUMENTS

| | | |
|---|---|---|
| EP | 0 057 554 A1 | 8/1982 |
| ES | 1 021 548 | 12/1992 |
| ES | 1 038 598 | 7/1998 |
| ES | 1 039 869 | 2/1999 |
| ES | 1 040 413 | 4/1999 |
| ES | 1 040 762 | 5/1999 |
| ES | 1 043 207 | 11/1999 |
| ES | 1 045 178 | 8/2000 |
| ES | 1 048 227 | 7/2002 |
| GB | 2 106 044 A | 4/1983 |
| JP | 11-139081 | 5/1999 |
| JP | 2000-025386 | 1/2000 |
| TW | 124347 | 4/1977 |
| TW | 193966 | 5/1981 |

* cited by examiner

*Primary Examiner*—Gene Mancene
*Assistant Examiner*—Huyen Le
(74) *Attorney, Agent, or Firm*—George W. Jonas

(57) ABSTRACT

The present invention is directed to a combined writing instrument/sheet material dispenser. The present invention is comprised of a body that has a tip portion, a sheet material dispenser portion and a grip portion disposed between the tip portion and the sheet material dispenser portion. Formed within the sheet material dispensing portion of the body is a compartment that is sized to receive and hold a stack of sheet material. The stack of sheet material is formed from a plurality of individual sheets that are adhered together with a releasable adhesive layer. A slot is formed in the sheet material dispensing portion of the body to communicate with the compartment and there by allow a top-most sheet in the stack to be exposed for use.

15 Claims, 7 Drawing Sheets

WRITING INSTRUMENT WITH SHEET DISPENSER

REFERENCE TO CO-PENDING APPLICATIONS

This is a non-provisional of provisional patent application Ser. No. 60/301,641, filed Jun. 28, 2001 by David C. Windorski, which is incorporated by reference herein in its entirety. Priority of this prior provisional application is claimed under 35 U.S.C. § 119(e).

BACKGROUND OF THE INVENTION

The present invention generally relates to devices for marking written or pictorial materials that may be deemed important to a person viewing such materials. In particular, the present invention relates to a writing instrument that incorporates a sheet material dispenser within the body of the writing instrument, for individually dispensing sheet material formed in a stack.

In the course of reviewing and studying printed materials, it is common for individuals to write marginal notes, underline text and even highlight portions deemed important. College or university students, for example, commonly use highlighter pens and/or colored pens or pencils to aid in reading and studying course materials. Locating particular such marked-up passages, however, often may require a search of several similarly marked-up pages. One product that facilitates locating a particular page or section of a page is a tape flag, such as those manufactured by 3M Company, St. Paul, Minn. under the trademark Post-it® flags. A typical manner of packaging sheet material formed in a stack and adhered together with a releasable adhesive layer along alternating opposing edges, e.g., in a Z-fold manner is disclosed in U.S. Pat. No. 4,770,320, which is incorporated by reference herein in its entirety. Various other dispensable sheet material stacks are known in the art, including those disclosed in U.S. Pat. Nos. 4,416,392, 4,781,306, and 5,417,345, which are incorporated herein by reference. For ease and convenience of access to both a writing instrument and tape flags or the like, it would be beneficial to house both in a single, easy to carry unit that is also not unattractive nor unpleasing to the professional eye.

BRIEF SUMMARY OF THE INVENTION

The present invention is directed to a combined writing instrument/sheet material dispenser. The present invention is comprised of a body that has a tip portion, a sheet material dispenser portion and a grip portion disposed between the tip portion and the sheet material dispenser portion. Formed within the sheet material dispensing portion of the body is a compartment that is sized to receive and hold a stack of sheet material. The stack of sheet material is formed from a plurality of individual sheets that are adhered together with a releasable adhesive layer. A slot is formed in the sheet material dispensing portion of the body to communicate with the compartment and there by allow a top-most sheet in the stack to be exposed for use.

DETAILED DESCRIPTION

Figure 1:
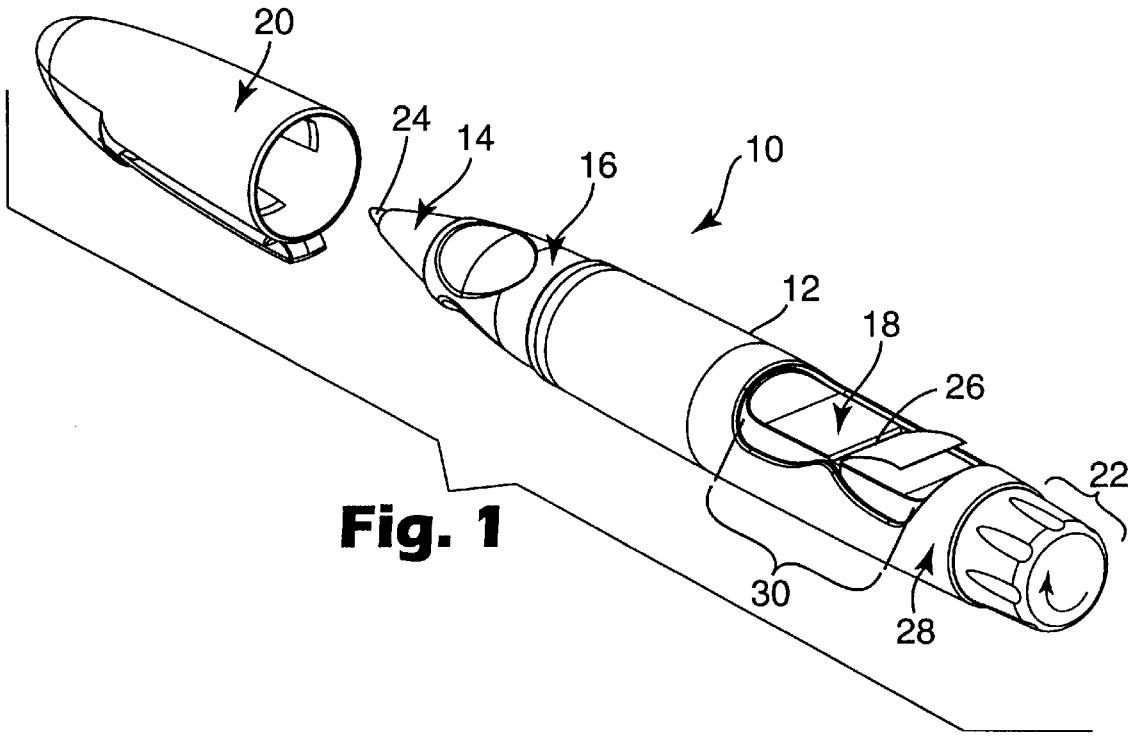
FIG. 1 is a perspective view of a first embodiment of a combination writing instrument/sheet material dispenser of the present invention.

A first embodiment of a combination writing instrument/sheet material dispenser 10 of the present invention is shown in FIG. 1. Generally, writing instrument 10 is defined by a body 12 that includes a tip portion 14, a grip portion 16 adjacent to tip portion 14 and a sheet material dispensing portion 18 adjacent to grip portion 16. In one preferred embodiment, body 12 is generally cylindrical with grip portion 16 and tip portion 14 being radially tapered. A cap 20 is provided to cover tip portion 14 and grip portion 16 when the writing instrument 10 is not being used to write (i.e., is being stored). Cap 20 can also be disposed on an end portion 22 of the sheet material dispensing portion 18 when writing instrument 10 is being used to write.

Extending from tip portion 14 in the first embodiment is a writing tip 24 of an ink cartridge (not shown) that is housed within body 12. Grip portion 16, positioned adjacent to the tip portion 14, and in one embodiment is preferably made of a natural rubber and is contoured to provide gripping surfaces that are designed to match the location of fingers when writing instrument 10 is held by a user. Grip portion 16 is disposed between tip portion 14 and sheet material dispensing portion 18. The sheet material dispensing portion 18 houses a stack of sheet material, one sheet of which is shown extending from body 12 through a slot 26. A cover 28 is provided around the sheet material dispensing portion 18 of body 12. In one preferred embodiment, writing instrument 10 of the present invention has a maximum outer diameter, defined by sheet material dispensing portion 18 and cover 28, of about 0.6 inches (15 millimeters) or less. The cover 28 includes an opening or window 30 that exposes the slot 26 when the cover 28 is in an open position. As will be discussed later in greater detail, the cover 28 is also rotatable to a closed position to cover the slot 26 when the sheet material dispensing portion 18 is not in use.

Figure 2A:
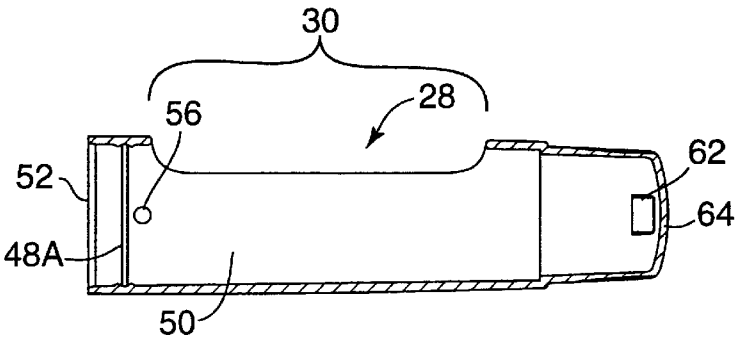
FIG. 2*a* is a longitudinal sectional view of a cover for the writing instrument/sheet material dispenser of the present invention shown in FIG. 2.
Figure 2:
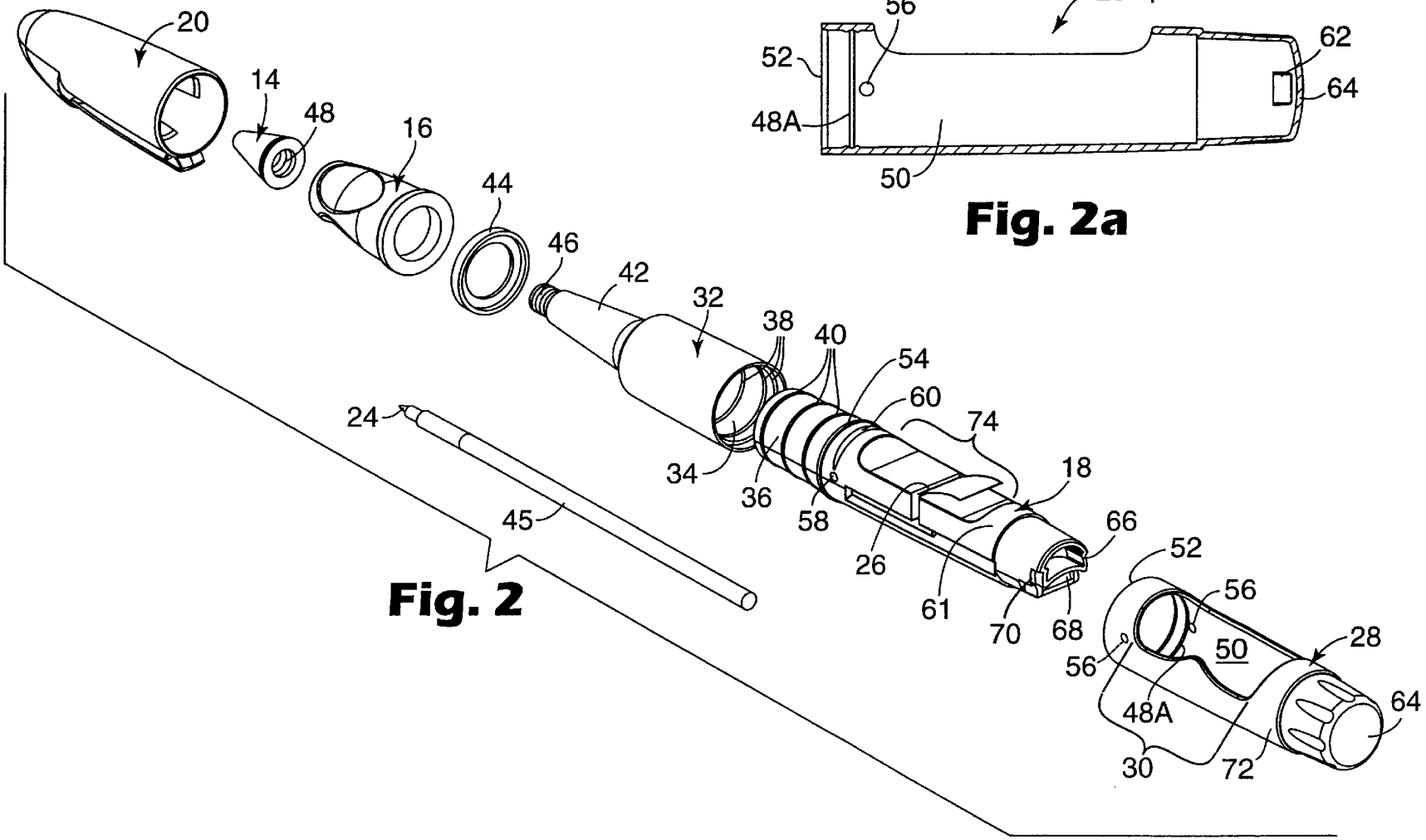
FIG. 2 is an exploded view of the combination writing instrument/sheet material dispenser of FIG. 1.

FIG. 2 is an exploded view of the combination writing instrument/sheet material dispenser 10 of FIG. 1. As shown in FIG. 2, sheet material dispensing portion 18, grip portion 16 and tip portion 14 are secured to a mounting portion 32. Mounting portion 32 has a female receiving end 34 configured for receiving a male end 36 of sheet material dispensing portion 18. The female receiving end 34 is provided with a plurality of spaced circumferential grooves 38 which are sized to receive a complimentary set of spaced circumferential ridges 40 on the male end 36 of sheet material dispensing portion 18. With male end 36 of sheet material dispensing portion 18 fully inserted into the female receiving end 34, ridges 40 seat in grooves 38 to hold sheet material dispensing portion 18 securely in place relative to mounting portion 32. Alternatively ridges 40 and grooves 38 could be reversed, or both could be ridges which engage and interlock. Mounting portion 32 and sheet material dispensing portion 18 may be formed from any suitable material, for example, by injection molding any suitable polymer. By way of a non-limiting example, one particularly beneficial polymer is ABS, a copolymer of acrylonitrile, butadiene and styrene, due to its qualities of strength, clarity (i.e., transparency) and an aesthetically pleasing high gloss sheen.

As further shown in FIG. 2, mounting portion 32 also includes a radially tapered male end 42 on which is mounted a decorative spacing ring 44, the grip portion 16 and the tip portion 14. The male end 42 includes an external threaded portion 46, which is sized to match internal threads 48 in tip portion 14. With ring 44 and grip portion 16 positioned over the male end 42, tip portion 14 is threaded onto threaded portion 46 thereby securing tip portion 14, grip portion 16 and ring 44 to mounting portion 32. Tip portion 14 and spacing ring 44 may be made from any suitable material, such as a metal or a polymer as previously described. As shown in FIG. 2, in one embodiment writing instrument 10 contains an ink cartridge 45 with a writing tip 24 that extends from tip portion 14 when writing instrument 10 is fully assembled such that ink cartridge 45 extends internally through grip portion 16, and may extend through sheet material dispensing portion 18. In an alternative embodiment (not shown), writing tip 24 may be retractable from tip portion 14.

As shown in FIGS. 2 and 2*a*, cover 28, which may also be formed of a polymer (or any other suitable material), includes an inner circumferential groove 48A formed on the inner circumferential surface 50 of cover 28 near the open end 52 of cover 28. Upon assembly of cover 28 to the sheet material dispensing portion 18, groove 48A mates with a circumferential ridge 54 on the sheet material dispensing portion 18 to hold cover 28 securely to sheet material dispensing portion 18, yet allowing cover 28 to rotate with respect to sheet material dispensing portion 18. Cover 28 is also provided with a pair of small protrusions 56 adjacent to the groove 48A, which are designed to mate with a pair of small depressions 58 on opposite sides of sheet material dispensing portion 18. Protrusions 56 and depressions 58 provide a positive location for cover 28 when it is in an open position (i.e., when window 30 is aligned to allow user access to slot 26, as shown in FIG. 1). Protrusions 56 also follow within a pair of arcuate guides 60 provided on diametrically opposite sides of outer surface 61 of the sheet material dispensing portion 18 when cover 28 is rotated from the open position to a closed position, as will be discussed subsequently in greater detail. It will be understood by a person skilled in the art that the placement of protrusions 56 and depressions 58 can be reversed, or located at any other position between cover 28 and sheet material dispensing portion 18.

To aid in aligning cover 28 with slot 26, the inner circumferential surface 50 of cover 28 is provided with a raised portion 62 adjacent to the closed end 64 of cover 28, as shown in FIG. 2*a*. With cover 28 in the open position, raised portion 62 bears against a first shoulder 66 formed in the outer surface of sheet material dispensing portion 18 at end 68 to ensure window 30 is properly positioned relative to slot 26. A second shoulder 70 is also provided at end 68 opposite first shoulder 66 such that when cover 28 is rotated in a clockwise direction, raised portion 62 will engage shoulder 70. With raised portion 62 engaging shoulder 70, a solid outer surface 72 of cover 28 is disposed such that dispensing region 74 of sheet material dispenser 18 (including slot 26) is covered (i.e., the closed position of cover 28), thereby preventing user access to slot 26.

Figure 3:
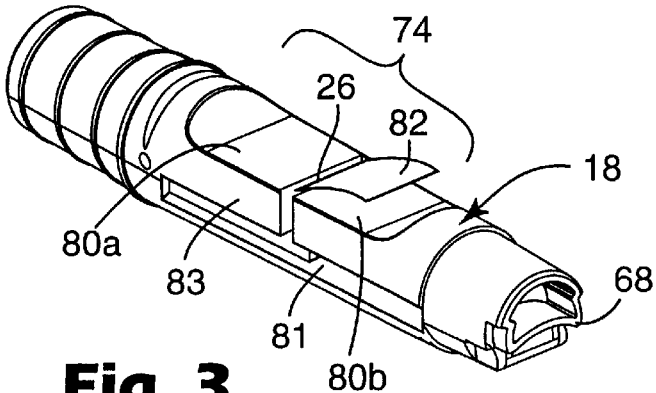
FIG. 3 is an enlarged perspective view of the sheet material dispensing portion of the writing instrument of FIG. 2.

FIG. 3 is an enlarged perspective view of the sheet material dispensing portion 18 of writing instrument 10. As shown in FIG. 3, the sheet material dispensing region 74 is formed in the outer surface of sheet material dispensing portion 18 to define a pair of flat surfaces 80*a* and 80*b* on either side of slot 26. Each flat surface 80*a* and 80*b* is dimensioned to accommodate the dimensions of the top-most sheet 82 extending from the slot 26. While sheet 82 is shown extending over surface 80*b*, it is to be understood that as a result of a Z-folding arrangement of the stack of sheet material (discussed in greater detail in U.S. Pat. No. 4,770,320) within sheet material dispensing portion 18, typically the next top-most sheet in the stack will face in an opposite direction over surface 80*a*.

As further shown in FIG. 3, slot 26 communicates with a compartment 81 that is formed within sheet material dispensing portion 18. Both slot 26 and compartment 81 are open and exposed through a side wall 83 of sheet material dispensing portion 18 for loading a stack of sheet material (not shown) by removal of the cover 28 (shown in FIG. 2). Surfaces 80*a* and 80*b* are preferably transparent to allow a user to monitor the volume of sheets remaining in compartment 81.

Figure 4:
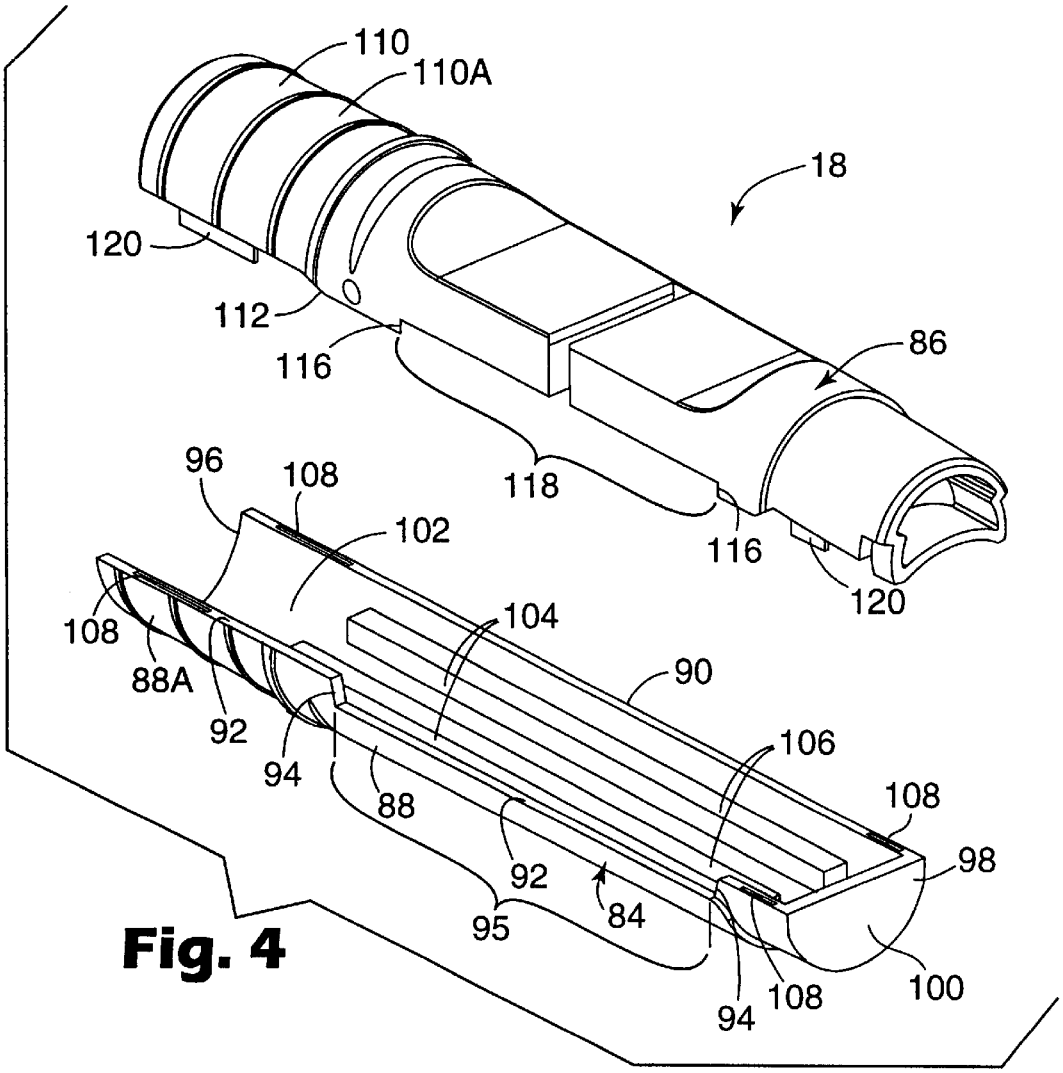
FIG. 4 is an enlarged exploded view of the sheet material dispensing portion of FIG. 3.

The construction of one embodiment of sheet material dispensing portion 18 is illustrated in FIG. 4, which is an enlarged exploded view of sheet material dispensing portion 18. As shown in FIG. 4, sheet material dispensing portion 18 is comprised of two sections: a base section 84 and a cover section 86. Base section 84 is defined by an elongated arcuate wall 88 (defining an outer surface 88A) that has first and second parallel edges 90 and 92. Edge 92 is provided with a pair of steps 94 to create a gap 95 in the wall 88 along edge 92. A first end 96 of base section 84 is open, while the opposite end 98 of base section 84 is closed by a transverse wall 100. Extending from the inner surface 102 of base section 84 is a pair of spaced ribs 104, which can be formed in the molding process. Ribs 104 define surfaces 106 that serve as a platform (or base) for holding a stack of sheet material. As shown in FIG. 4, by way of a non-limiting example, ribs 104 have a length greater than the gap 95 formed in wall 88. Ribs 104 preferably are long enough so as to provide a sufficient contact surface to support a stack of sheet material. In an alternative embodiment, an adequate base for a stack of sheet material is formed by replacing ribs 104 with a plurality of ribs oriented 90 degrees to ribs 104. For ease of assembly of sheet material dispensing portion 18, edges 90 and 92 are configured with grooves 108 at end portions of base section 84. The space between the platform and the wall 88 may be used to provide space for ink cartridge 45, discussed previously.

The cover section 86 is also defined by an arcuate wall 110 defining outer surface 110A that is sized and configured to mate with wall 88 of base section 84. Edge 112 is provided with a pair of spaced steps 116 to define a second gap 118 in wall 110 that preferably is equal in length to gap 95 in the wall 88 of base section 84. End portions of cover section 86 are configured with protrusions (such as protrusions 120 shown extending from edge 112), which are sized to seat with each of grooves 108 when the base section 84 and the cover section 86 are assembled. Connection of cover section 86 to base section 84 may be accomplished, for example, by either sonic welding or adhering protrusions 120 within grooves 108. With cover section 86 connected to base section 84, gaps 95 and 118 collectively define an opening to compartment 81 (as shown previously in FIG. 3).

Figure 5:
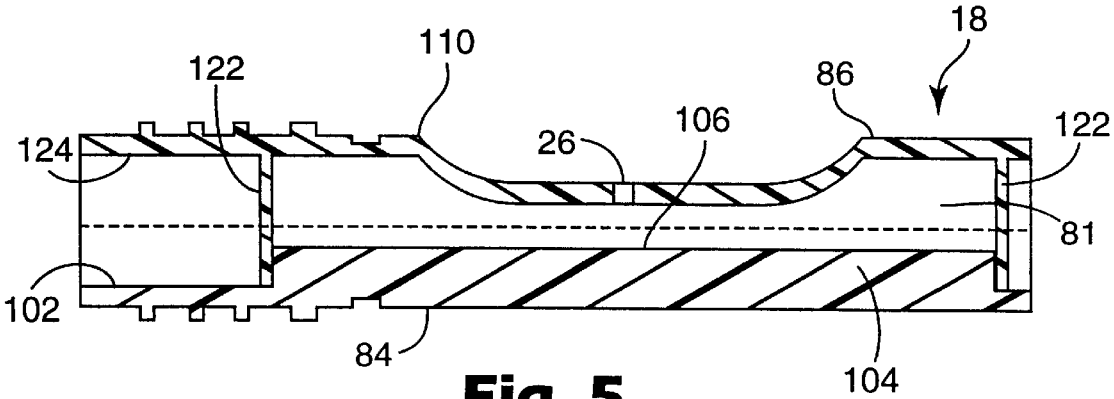
FIG. 5 is a longitudinal sectional view of one embodiment of the sheet material dispensing portion.

FIG. 5 is a longitudinal sectional view of an assembled sheet material dispensing portion 18. As shown in FIG. 5, cover section 86 includes a pair of spaced inner walls 122, which extend from the inner surface 124 of cover section 86. Inner walls 122 are formed in the molding process and serve to define the length of compartment 81, which in one preferred embodiment is about 2 inches (60 millimeters). Surface 106 of ribs 104 defines the base of compartment 81, while wall 110 of cover section 86 defines a cover for compartment 81. Ribs 104 and wall 110 define the height of compartment 81, which in one preferred embodiment is about 0.1 inches (3 millimeters). Inner surfaces 124 and 102 of cover section 86 and base section 84, respectively, define the width of compartment 81, which span the diameter of sheet material dispensing portion 18. In one preferred embodiment, the width of compartment 81 is about 0.4 inches (10 millimeters). Slot 26 preferably has a width of about 0.08 inches (2 millimeters).

Figure 5A:
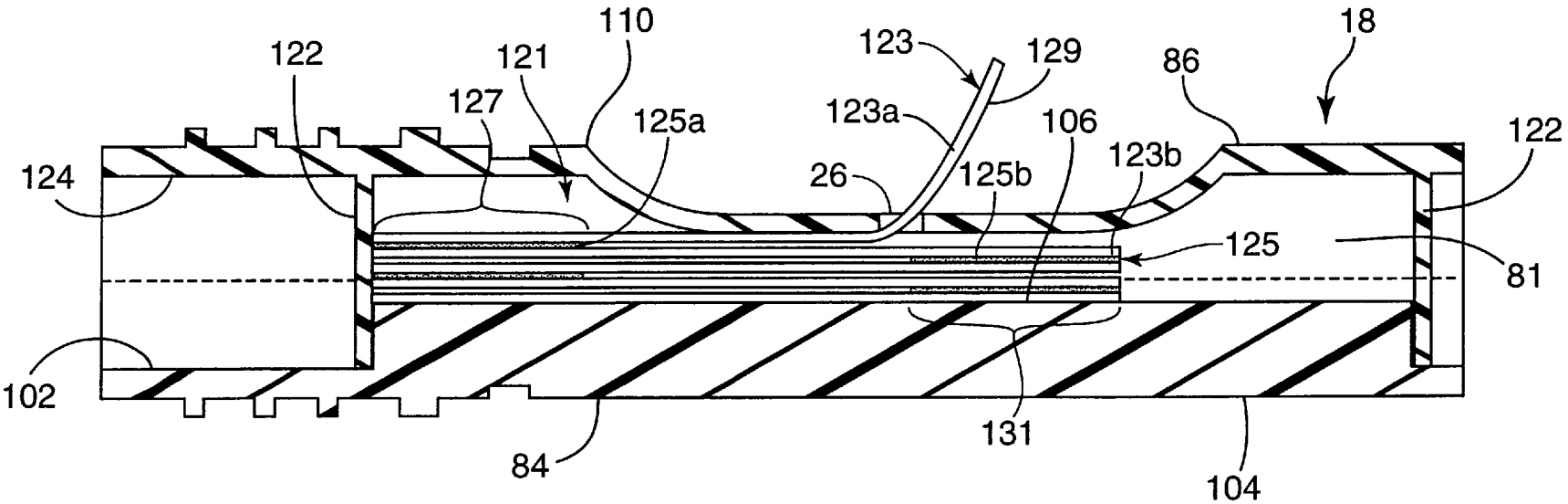
FIG. 5*a* is a longitudinal sectional view of one embodiment of the sheet material dispensing portion with a stack of sheet material in the compartment of the sheet material dispensing portion.

A stack of sheet material 121 within compartment 81 is shown in FIG. 5*a*. Stack 121 is comprised of a plurality of vertically aligned individual sheets 123 that are releaseably adhered to each another in a Z-fold manner along alternating opposite end portions by a layer 125 of a pressure sensitive adhesive. For example, a top-most sheet 123*a*, which is shown extending through slot 26, includes a layer of adhesive 125*a* along a first end portion 127 on a lower surface 129 of sheet 123*a*. The subsequent sheet 123*b* in stack 121 includes a layer of adhesive 125*b* along a second end portion 131. As shown in FIG. 5*a*, compartment 81, has a length greater than that of stack 121, which permits stack 121 to shuttle within compartment 81 from end to end (i.e., between walls 122) as each sheet 123 is dispensed through slot 26 as further described in U.S. Pat. No. 4,770,320, which is incorporated herein by reference. In one preferred embodiment, a full stack of sheet material 121 used with the present invention has a width of about 0.4 inches (10 millimeters), a height of about 0.13 inches (3.3 millimeters) and a length of about 1.7 inches (44 millimeters).

Figure 6:
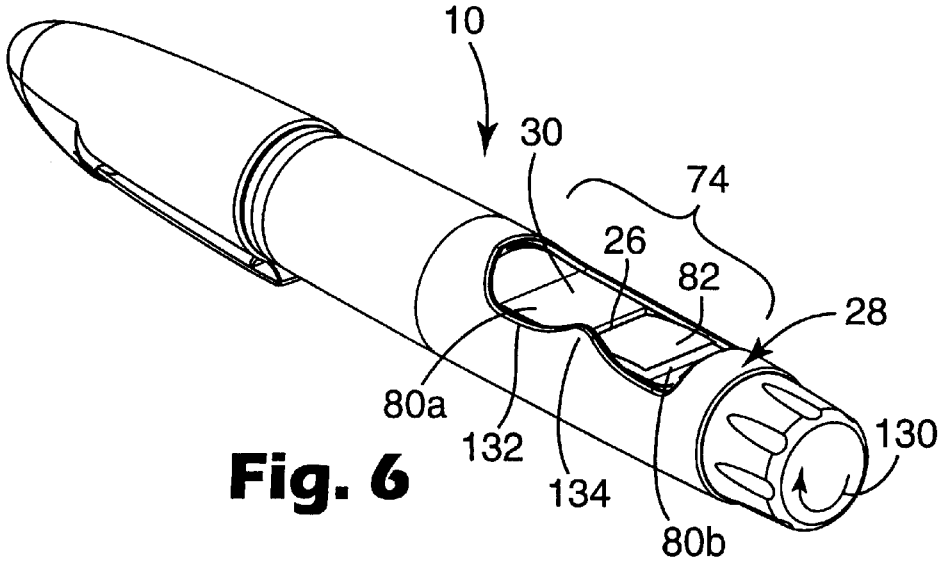
FIG. 6 is a perspective view of the combination writing instrument/sheet material dispenser of FIG. 1 with the cover partially rotated.
Figure 7:
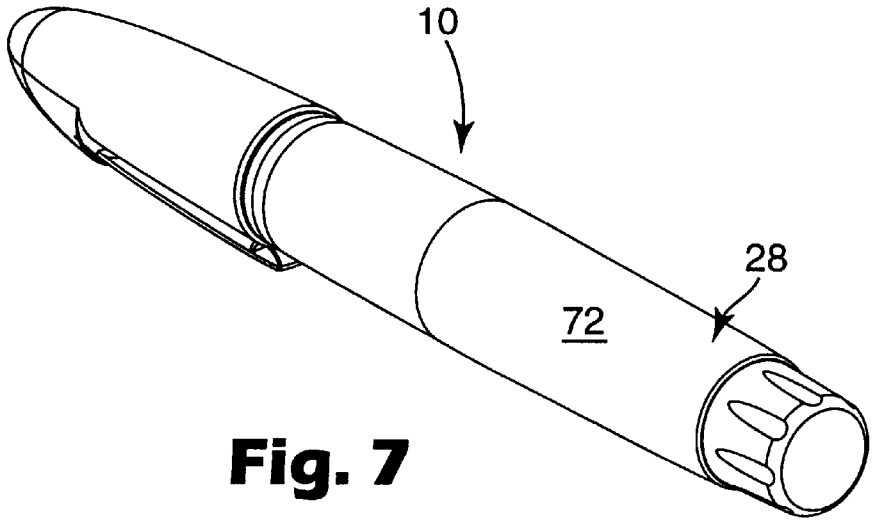
FIG. 7 is a perspective view of the combination writing instrument/sheet material dispenser of FIG. 1 with the cover fully rotated to the closed position.

The operation of cover 28 is shown in FIGS. 6 and 7. When it is desired to use writing instrument 10 only for writing, or when writing instrument 10 is being transported, it is preferred to cover dispensing region 74 to prevent the top-most sheet 82 extending through slot 26 from being soiled, damaged or inadvertently removed. As previously alluded to, cover 28 is moved from an open position to a closed position by rotating cover 28 in a particular direction, for example, in a clockwise direction as shown by arrow 130. One edge 132 of window 30 is configured with a medial tapered edge extension 134 that is axially aligned with slot 26. Upon initial rotation of cover 28, edge extension 134 engages and covers the edge of top-most sheet 82 where it emerges from slot 26, forcing sheet 82 down towards surfaces 80*a* or 80*b*, depending upon which direction top-most sheet 82 is pointing. Upon further rotation of cover 28, edge 132 of window 30 continues to guide sheet 82 beneath cover 28 until outer surface 72 of cover 28 completely covers dispensing region 74, as shown in FIG. 7. Alignment of cover 28 in the closed position is aided by raised portion 62 engaging shoulder 70, as previously discussed with respect to FIGS. 2 and 2*a*.

Figure 8:
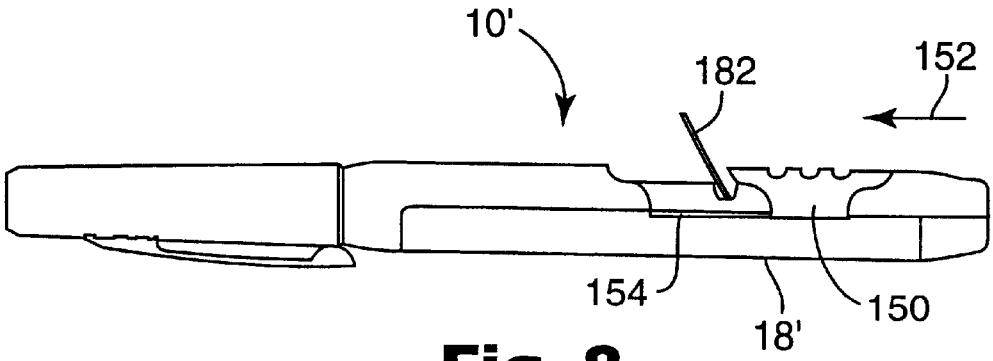
FIG. 8 is a side view of a second embodiment of the combination writing instrument/sheet material dispenser of the present invention.

FIG. 8 is a side view of an alternative embodiment of a cover 150 for writing instrument 10' of the present invention. As shown in FIG. 8, cover 150 is designed to slide from an open position with top-most sheet 182' exposed, as shown in FIG. 8, to a closed position by movement in the direction indicated by arrow 152. Cover 150 is mounted within a track 154 formed in the sheet material dispensing portion 18'. Other means for covering the sheet material dispensing region of the present invention will be apparent to those skilled in the art.

Figure 9:
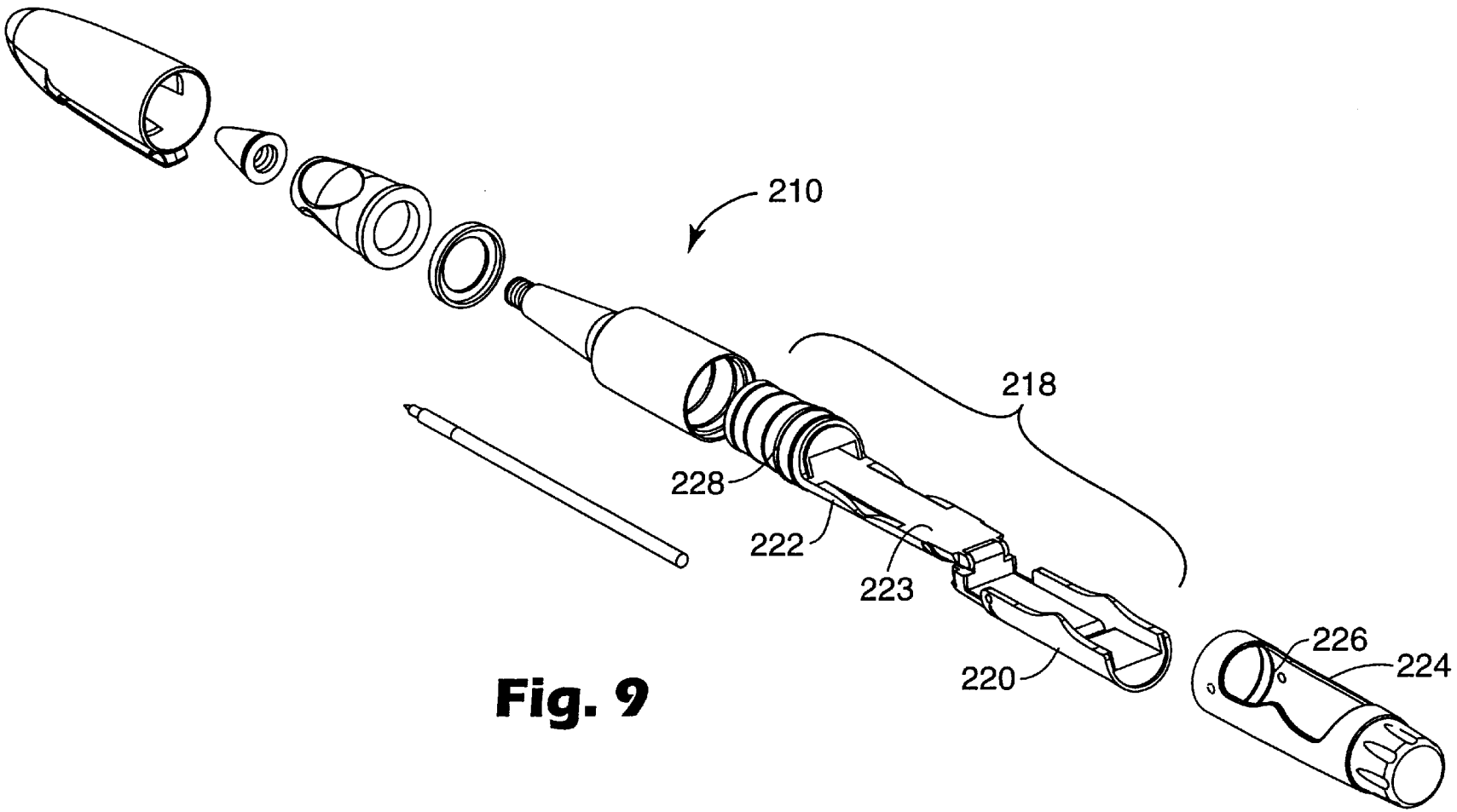
FIG. 9 is an exploded view of a third embodiment of the combination writing instrument/sheet material dispenser of the present invention.

FIG. 9 is an exploded view of yet another embodiment of the present inventive writing instrument 210. As shown in FIG. 9, sheet material dispensing portion 218 may be modified to provide an alternative access to the sheet material dispensing compartment by pivotally connecting cover section 220 to base section 222. Upon assembly, cover section 220 is rotated into contact with base section 222 to seal a stack of sheet material (not shown) within the compartment. As shown in FIG. 9, base section 222 may comprise a contiguous surface 223 for holding a stack of sheet material, in lieu of ribs 104 as shown in FIGS. 4–5. Cover section 220 and base section 222 are maintained relative to one another by cover 224 when inner circumferential groove 226 of cover 224 mates with the circumferential ridge 228 of sheet material dispensing portion 218.

Figure 10:
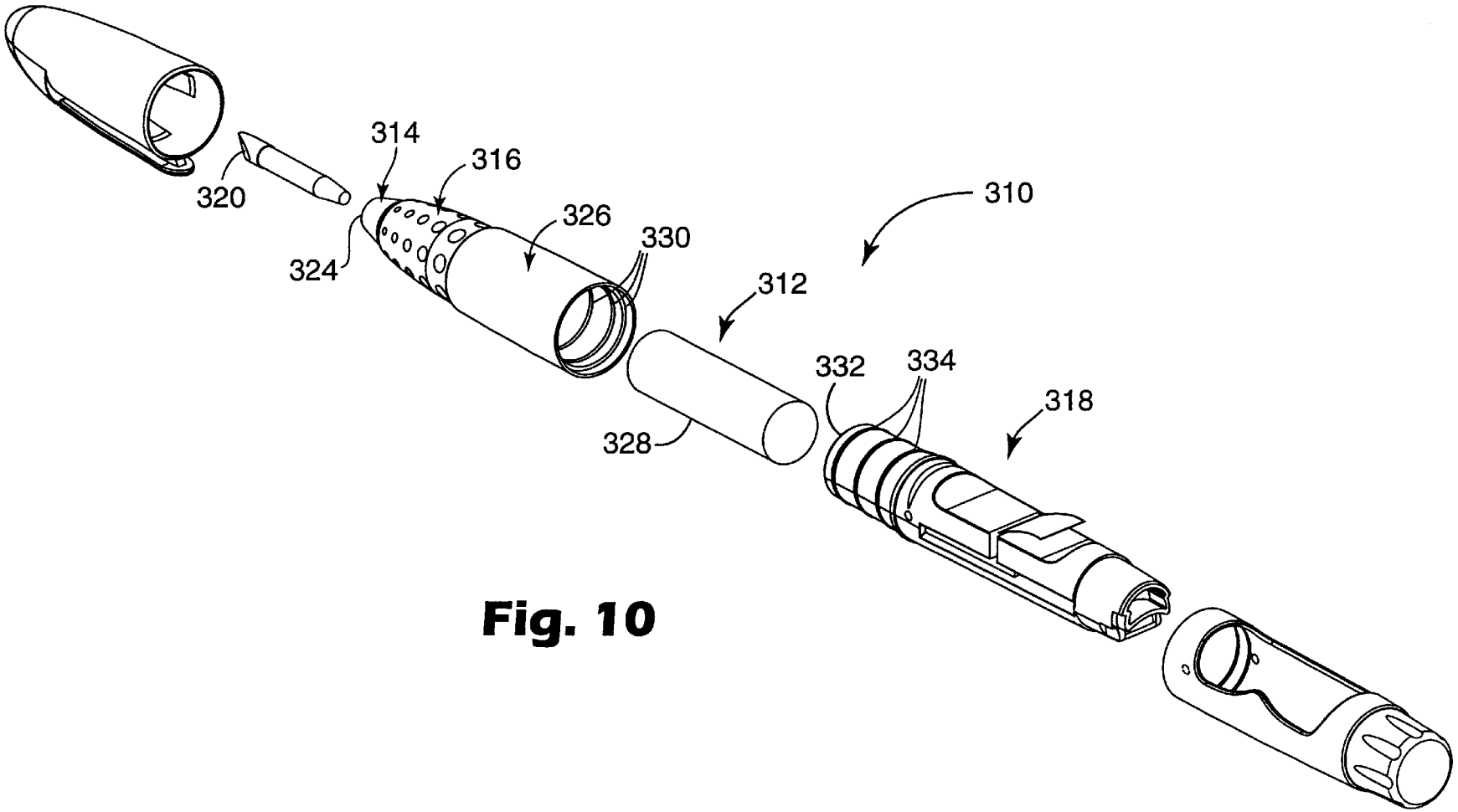
FIG. 10 is an exploded view of a fourth embodiment of the combination writing instrument/sheet material dispenser of the present invention. While the above-identified drawing figures set forth preferred embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention. It should be specifically noted that the figures have not been drawn to scale as it has been necessary to enlarge certain portions for clarity. Throughout the embodiments, like reference numerals are used for like elements.

FIG. 10 is an exploded view of another embodiment of the writing instrument 310 of the present invention in which the writing instrument is a highlighter pen. As shown in FIG. 10, writing instrument 310 generally includes a body 312 that has a tip portion 314, a grip portion 316, and a sheet material dispensing portion 318. Associated with tip portion 314 is writing tip (or nib) 320. Writing tip 320 is inserted into an end 324 of tip portion 314 until writing tip 320 seats against end 324.

Grip portion 316 is connected to tip portion 314 and to a cylindrical chamber 326 which contains an ink reservoir in the form of inkpad 328 loaded with highlighter ink. Inkpad 328 communicates with wick 322 upon assembly of body 312. Like mounting portion 32 of FIG. 2, cylindrical chamber 326 is provided with a series of spaced inner circumferential grooves 330 to create a sealing connection between cylindrical chamber 326 and sheet material dispensing portion 318. In the embodiment illustrated by FIG. 10, cylindrical chamber 326 is preferably made of a polymer that provides good vapor barrier protection for inkpad 328, such as polypropylene. Sheet material dispensing portion 318 is constructed substantially as disclosed with respect to the embodiment described in FIGS. 1–7, with the exception that end 332 is entirely plugged to prevent air from entering cylindrical chamber 326. Sheet material dispensing portion 318 includes a series of circumferential ridges 334 which when mated to circumferential grooves 330 preferably provide an air tight seal of sheet material dispensing portion 318 to chamber 326.

While examples of an ink pen version and a highlighter pen version of the present invention have been disclosed, such examples are non-limiting. The present invention can also be applied to pencils, markers and other writing instruments, the design or shape of which can have infinite variations.

Although the present invention has been described with reference to preferred embodiments, workers skilled in the art will recognize that changes may be made in form and detail without departing from the spirit and scope of the invention. Also, various permutations of the present invention are possible by exchanging corresponding features of the various embodiments.

What is claimed is:

1. A writing instrument with a sheet material dispenser comprising:

a body having a tip portion, a sheet material dispenser portion and a grip portion disposed between the tip portion and the sheet material dispenser portion;

a compartment within the sheet material dispenser portion, the compartment having a width generally defined by a diameter of the body, a length and a height, the width, length and height of the compartment sized to receive a similarly dimensioned stack of sheet material, wherein the sheet material dispensing portion of the body comprises a cover of the compartment, the cover including a slot extending through the cover and in communication with the compartment;

a stack of sheet material within the compartment, the stack of sheet material comprising a plurality of sheets adhered together with a releasable adhesive layer, wherein a top-most sheet of the stack extends through the slot; and a cover coaxially positioned around the sheet material dispensing portion of the body, wherein the cover is rotatable from a first position to a second position, the cover having a circumferential wall configured to define a window, the window aligned with and exposing the top-most sheet of the stack when the cover is in the second position, the circumferential wall of the cover covering the top-most sheet of the stack when the cover is in the first position; and wherein the window comprises a perimeter edge having first and second edge portions generally parallel to the slot, and third and fourth edge portions transverse to the first and second edge portions, wherein one of the third and fourth edge portions includes a medial edge extension.

2. The writing instrument of claim 1 wherein the sheet material dispensing portion of the body comprises a circumferential wall which defines an inner surface and an outer surface of the body, and wherein the compartment comprises a base connected to the inner surface of the body, a pair of end walls connected to the inner surface of the body and a pair of side walls defined by the inner surface of the body.

3. The writing instrument of claim 2 wherein the base extends from a first portion of the inner surface of the body along the length of the compartment, the base defining a space between the base and the inner surface of the body.

4. The writing instrument of claim 3 wherein the writing instrument comprises an elongated ink cartridge having a writing tip, the writing tip extending from the tip portion of the body, the ink cartridge extending through the grip portion of the body.

5. The writing instrument of claim 4 wherein an end portion of the ink cartridge extends in the sheet material space defined by the base and the outer wall of the sheet dispensing portion.

6. The writing instrument of claim 2 wherein the pair of end walls are positioned at opposite ends of the base.

7. The writing instrument of claim 2 wherein the wall of the sheet material dispensing portion of the body is configured to define an opening along at least one wall of the pair of side walls of the compartment.

8. The writing instrument of claim 1 and further including a chamber connected between the grip portion and the sheet material dispensing portion of the body, the chamber containing an ink reservoir in fluid communication with a writing tip extending from the tip portion.

9. The writing instrument of claim 8 wherein the ink reservoir comprises an inkpad loaded with highlighter ink.

10. A housing for a writing instrument and a stack of sheet material, the housing comprising:

a hollow elongated body having a tip portion, a writing tip extending from one tip portion, a grip portion and a sheet material dispensing portion wherein the grip portion is disposed between the tip portion and the sheet material dispensing portion; and a compartment within the sheet material dispenser portion, the compartment having a base, side walls and a cover defined by the body, the compartment sized to receive a similarly dimensioned stack of sheet material, wherein the cover is configured to define a slot between opposing side walls of the compartment to permit a sheet from the stack to extend from the compartment therethrough;

wherein the sheet material dispensing portion comprises a base section and a cover section pivotally connected to the base section, the base section defining a support surface for the stack of sheet material, the cover section defining the side walls and the cover; and wherein the base section is configured to define an opening through a side wall of the body for insertion of the stack of sheet material within the compartment.

11. The housing of claim 10 wherein the compartment has a height of about 0.1 inches (3. millimeters), a length of about 2. inches (60 millimeters) and a width of about (0.4 inches (10 millimeters).

12. The housing of claim 11 wherein the stack of sheet material has a width of about 0.13 inches (3.3 millimeters) and a length of about 1.7 inches (44 millimeters).

13. A housing for a writing instrument and a stack of sheet material, the housing comprising:

a hollow elongated body having a tip portion, a writing tip extending from one tip portion, a grip portion and a sheet material dispensing portion wherein the grip portion is disposed between the tip portion and the sheet material dispensing portion;

a compartment within the sheet material dispenser portion, the compartment having a base, side walls and a cover defined by the body, the compartment sized to receive a similarly dimensioned stack of sheet material, wherein the cover is configured to define a slot between opposing side walls of the compartment to permit a sheet from the stack to extend from the compartment therethrough;

a cover coaxially positioned around the sheet material dispensing portion of the body, wherein the cover is rotatable from the first position to the second position, the cover having a circumferential wall configured to define a window, the window aligned with and exposing the slot and top-most sheet of the stack when the cover is in the second position, the circumferential wall of the cover covering the slot and top-most sheet of the stack when the cover is in the first position; and wherein the window comprises a perimeter edge having first and second edge portions generally parallel to the slot, and third and fourth edge portions transverse to the first and second edge portions, wherein one of the third and fourth edge portions includes a medial edge extension.

14. The housing of claim 13 wherein the movable enclosure and the body define a maximum outer diameter of the housing.

15. The housing of claim 14 wherein the maximum outer diameter of the housing is about 0.5 inches (13 millimeters).

* * * * *

UNITED STATES PATENT AND TRADEMARK OFFICE

CERTIFICATE OF CORRECTION

PATENT NO. : 6,719,472 B2
DATED : April 13, 2004
INVENTOR(S) : Windorski, David C.

It is certified that error appears in the above-identified patent and that said Letters Patent is hereby corrected as shown below:

Column 8,
Line 48, delete "(" before "0.4".

Signed and Sealed this

Twenty-eighth Day of December, 2004

JON W. DUDAS
*Director of the United States Patent and Trademark Office*